US012742586B2

(12) United States Patent
Longo et al.

(10) Patent No.: US 12,742,586 B2
(45) Date of Patent: Sep. 22, 2026

(54) REFRIGERATOR APPLIANCE WITH PULLOUT-DRAWER ASSEMBLY

(71) Applicant: WHIRLPOOL CORPORATION, Benton Harbor, MI (US)

(72) Inventors: Luiz Longo, Joinville (BR); Everton Machado, Joinville (BR); Arthur A. Marcon, St. Joseph, MI (US); Alison W. Pereira, Saint Joseph, MI (US); Matheus Zappelini, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 295 days.

(21) Appl. No.: 18/344,019

(22) Filed: Jun. 29, 2023

(65) Prior Publication Data

US 2025/0003674 A1 Jan. 2, 2025

(51) Int. Cl.

*F25D 17/08* (2006.01)
*F25D 17/04* (2006.01)
*F25D 25/02* (2006.01)

(52) U.S. Cl.

CPC ..... *F25D 17/08* (2013.01); *F25D 17/045* (2013.01); *F25D 25/025* (2013.01)

(58) Field of Classification Search

CPC ..... F25D 17/08; F25D 17/045; F25D 25/025; F25D 2317/067; F25D 17/065; F25D 2317/061; A47B 2210/175; F25C 5/24; F25C 1/147; F25C 5/182; F25C 2400/04; F25C 2400/14; F25C 5/20

See application file for complete search history.

(56) References Cited

U.S. PATENT DOCUMENTS

| | | | | |
|---|---|---|---|---|
| 4,671,078 | A * | 6/1987 | Pink | F25D 17/065 62/408 |
| 9,074,810 | B2 * | 7/2015 | Hwang et al. | F25D 25/025 |
| 10,203,146 | B2 | 2/2019 | Jung | |
| 2016/0286998 | A1 * | 10/2016 | Lindbo et al. | F25D 17/08 |
| 2017/0059228 | A1 * | 3/2017 | Hu et al. | F25B 13/00 |
| 2018/0224186 | A1 * | 8/2018 | Besore et al. | F25D 17/065 |
| 2021/0254890 | A1 * | 8/2021 | Benitsch et al. | F25D 25/021 |
| 2022/0354249 | A1 * | 11/2022 | Nichols et al. | A61M 5/008 |
| 2024/0261832 | A1 * | 8/2024 | Wang et al. | B09B 3/35 |

FOREIGN PATENT DOCUMENTS

GB 2380538 A 9/2003

* cited by examiner

*Primary Examiner* — Jerry-Daryl Fletcher
*Assistant Examiner* — Dario Antonio Deleon
(74) *Attorney, Agent, or Firm* — Brooks Kushman, P.C.

(57) ABSTRACT

A refrigerator appliance includes a cabinet defining a refrigeration cavity having side-by-side first and second compartments. One or more shelves are disposed in the first compartment. The appliance further includes a pullout-drawer assembly associated with the second compartment. The assembly includes a cradle slidably connected to the second compartment such that the cradle is horizontally slidable in a front-to-rear direction between an open position in which the cradle projects from the second compartment and a closed position in which the cradle is fully received with the second compartment. The cradle defines at least one bin configured to store a food item. A cold-air system includes a first duct having a first vent opening into the first compartment, and a second duct having a second vent opening into the second compartment.

15 Claims, 4 Drawing Sheets

REFRIGERATOR APPLIANCE WITH PULLOUT-DRAWER ASSEMBLY

TECHNICAL FIELD

This disclosure relates to refrigerator appliances.

BACKGROUND

In order to keep food fresh, a low temperature must be maintained within a refrigerator to reduce the reproduction rate of bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

According to one embodiment, a refrigerator appliance includes a cabinet defining a refrigeration cavity having side-by-side first and second compartments. One or more shelves are disposed in the first compartment. The appliance further includes a pullout-drawer assembly associated with the second compartment. The assembly includes a cradle slidably connected to the second compartment such that the cradle is horizontally slidable in a front-to-rear direction between an open position in which the cradle projects from the second compartment and a closed position in which the cradle is fully received with the second compartment. The cradle defines at least one bin configured to store a food item. A cold-air system includes a first duct having a first vent opening into the first compartment, and a second duct having a second vent opening into the second compartment.

The pullout-drawer assembly may further include a door that seats against the cabinet when the cradle is in the closed position. The door may include a seal or gasket to reduce the loss of cold air from the compartments.

The at least one bin may be a plurality of vertically arranged bins. Each of the bins may be received on holders mounted on or integral with the cradle. The holders may be located on front and back members of the cradle.

The cradle may have a back member, a front member, a top member, and a bottom member arranged to form a rectangle. One or more of the members may be hollow. The members may be separately formed or integrally formed. The members may be portions of an injection-molded component. The injection molded component may be formed in two halves that are connected together to form the cradle. At least one of the members may be hollow. For example, the back member may be hollow. In one or more embodiments, all of the members are hollow.

The cradle may define an opening in fluid communication with the second vent. The opening may be formed in the back member of the cradle. A gasket may seal between the opening and the vent. The gasket may circumscribe the second vent such that, when the cradle is in the closed position, the gasket engages with the back member of the cradle and surrounds the opening.

A flow guide may be disposed in the cradle and aligned with the opening. For example, the flow guide may be disposed in the back member. The flow guide is configured to circulate air through the cradle to the at least one bin. The flow guide may define a channel extending in the front-to-rear direction. The channel may have a variable cross-sectional area. The channel may taper from the back to the front with the cross-sectional area being largest at the back. That is, a cross-sectional area of the channel at a back of the flow guide is larger than at a front of the flow guide.

The flow guide may be formed of a different material than the cradle. The flow guide may be formed of foam. The foam may be expanded polystyrene.

The pullout-drawer assembly may further include a slider having a first rail fixed to the second compartment and a second rail fixed to the cradle, wherein the first and second rails are configured to slide relative to each other to move the cradle between the open and closed positions. The slider may include one or more friction-reducing components, such as rollers or bearings.

According to another embodiment, a refrigerator appliance includes refrigeration cavity, a divider received in the cavity to form first and second compartments, and a pullout-drawer assembly associated with the second compartment. The assembly has a cradle that is slidable into and out of the second compartment. At least one food-storage bin supported on the cradle. A cold-air system of the refrigerator appliance includes a first duct having a first vent opening into the first compartment and a second duct having a second vent opening into the second compartment.

The divider may define an opening so that the first and second compartment are in fluid communication. The opening may be a plurality of openings. The divider may include an outer frame and horizontal member(s) connecting between front and back members of the frame. Multiple openings may be provided and defined between the frame and the openings.

The cradle may have a hollow backwall with opposing first and second panels defining first and second openings, respectively, that are aligned with each other. The cradle may further have a flow guide disposed in the backwall and defining a channel that extends from the first opening to the second opening. The second opening may engage with the second vent when the pullout-drawer assembly is in a closed position.

According to yet another embodiment, a refrigerator appliance includes a fresh-food compartment and a pullout-drawer assembly slidable received within the compartment. The assembly includes a cradle having a front member, a back member, a top member, and a bottom member. The back member is hollow. A flow guide is disposed in the back member and defines an air channel. A plurality of stacked bins are vertically arranged on the cradle. An air is vent arranged to supply an air stream to the channel when the pullout-drawer assembly is closed.

The refrigerator may further include a second vent arranged to supply another air stream to another portion of the compartment. The refrigerator may further include a divider. The first and second vents may be on opposite sides of the divider. The divider may define on or more openings allowing air to pass therethrough.

A second flow guide may be disposed in the back member under the first flow guide. The second flow guide be associated with a second vent and defines a second channel. The cross-sectional area of the second flow guide may be different than the first. For example, the channel of the upper (first) flow guide may be larger than the lower (second) flow guide.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
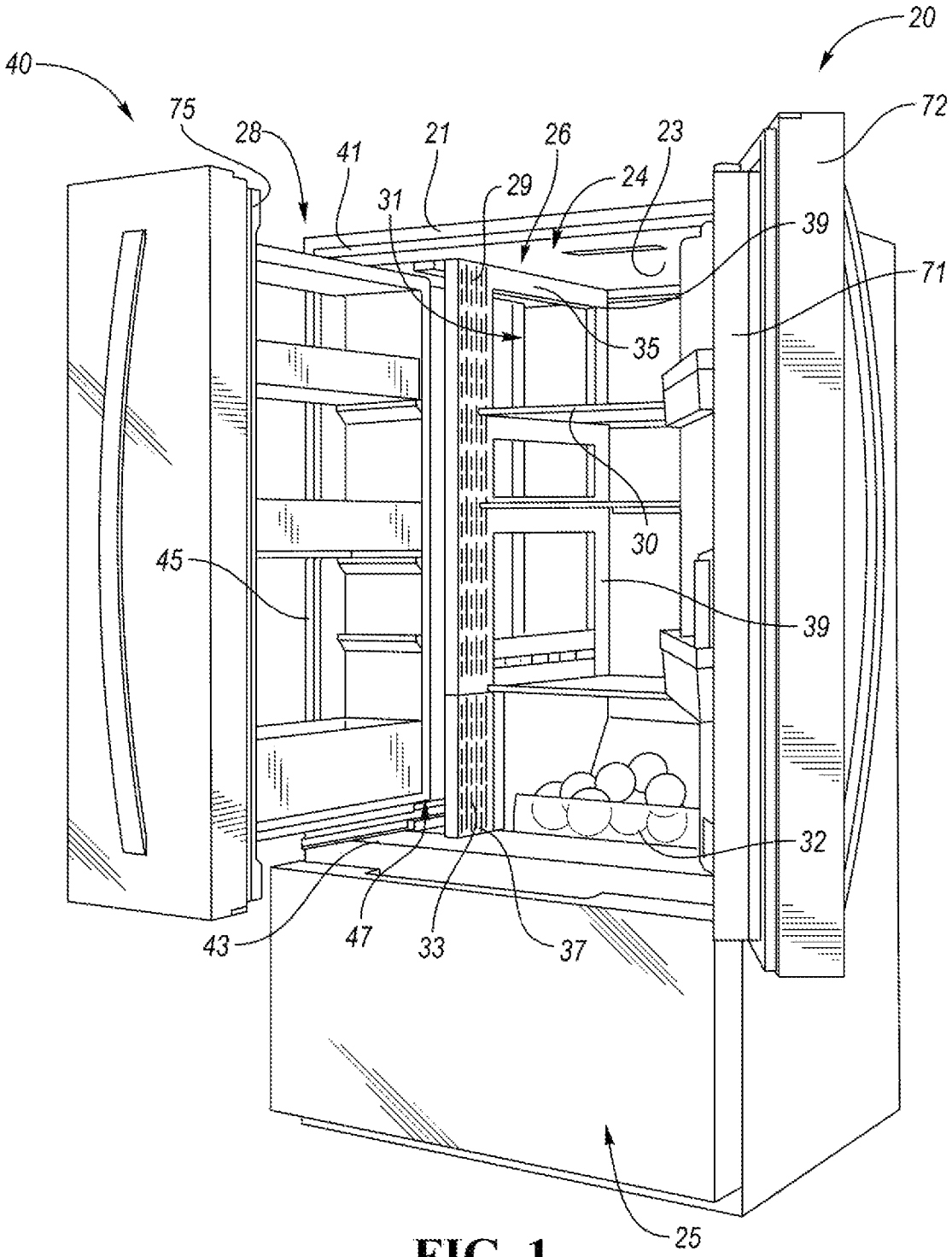
FIG. 1 is a front perspective view of a refrigerator appliance.

Referring to FIG. 1, a refrigerator appliance 20 includes an outer housing or cabinet 21 that forms the exterior of the appliance 20. The cabinet 21 may be formed of metal or other suitable material. Within the cabinet 21 are one or more food-storage areas such as a fresh-food area 24 and a freezer area 25. The refrigerator appliance 20 may include one or more liners 23 that define the areas. The liner 23 may be a plastic or the like and surrounded by thermal insulation, e.g., foam, disposed between the cabinet 21 and the liner 23. In one or more embodiments, the refrigerator applicant may include separate liners for the fresh-food area 24 and the freezer area 25.

The fresh-food area 24 includes two side-by-side compartments, a main compartment 26 and a pullout-drawer compartment 28. The main compartment may be larger than the pullout portion. The main compartment 26 may include a plurality of stacked shelves 30. One or more of the shelves 30 may be stationary but may be removable for cleaning or the like. Some of the shelves 30 may have portions that fold or slide to different configurations. The main compartment may also include a drawer 32 that slides in and out. The shelves may be glass supported by a plastic boarder. The shelves 30 are supported by supports that are attached to or integral with the liner 23. The positions of the shelves may be vertically adjusted by changing the supports upon which the shelves 30 are supported.

The pullout-drawer compartment 28 is adjacent to the main compartment 26. These compartments may be isolated from each other or may be in fluid communication with each other, i.e., there is not a full wall within the fresh-food area 24 separating the two compartments, and instead, there is open area allowing air to travel between the compartments. The pullout-drawer compartment 28 may include a divider wall 29 (divider), which may include one or more openings 31 allowing air to pass between the compartments 26 and 28. For example, the divider may define three large openings as shown in FIG. 1. The divider wall 29 may include a front vertical member 33, a header 35, a footer 37, a rear vertical member 39 that cooperate to define the outer boarder of the divider 29. The divider wall 29 may be formed of plastic or the like and may be hollow. The members may be integrally formed as a single piece or may be separately formed and connected together to form the divider wall 29. The front vertical member 33 may define small slots 41 for ventilation through the divider 29. The front vertical member 33 cooperates with the top and bottom walls 41, 43 and the sidewall 45 of the compartment 28 to define an opening 47 of the pullout-drawer compartment 28.

The divider wall 29 may include horizontal members 49 that extend between the front vertical member 33 and the rear vertical member 39. In the illustrated embodiment, multiple horizontal members 49 are provided. The horizontal members 49 are vertically stacked relative to each other. At least some of the horizontal members 49 may include shelf supports 51, which may be integrally formed therewith or separate components that are attached to the horizontal members. The openings 31 may be partially defined by horizontal members 49. For example, the top opening is defined between the header 35, the front member 33, the rear member 39, and the upper horizontal member 49. The middle opening is defined between the front member 33, the rear member 39, and two horizontal members 49. The lower window is defined between the front member 33, the rear member 39, and a pair of horizontal members.

Figure 2:
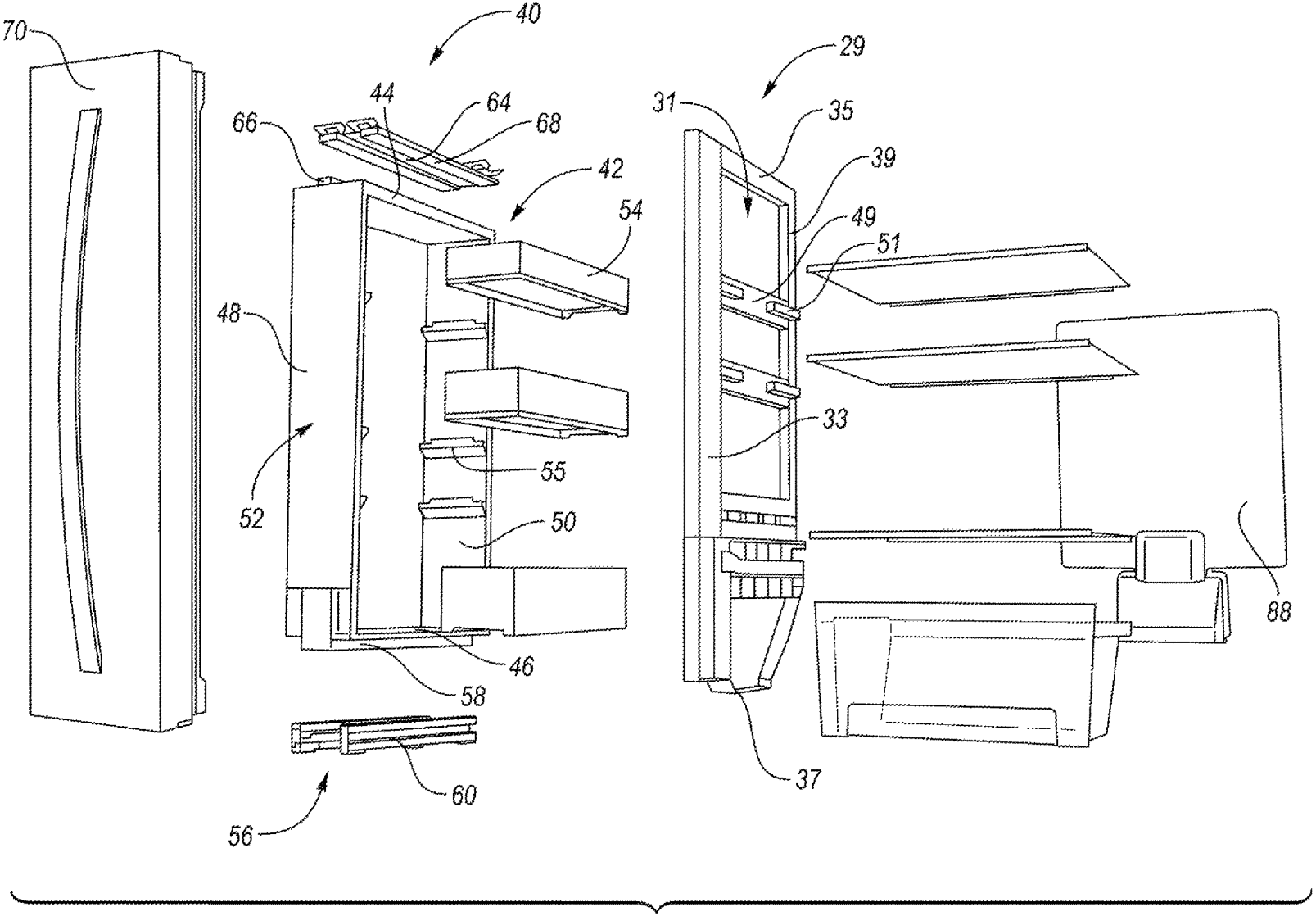
FIG. 2 is partial exploded perspective view of the refrigerator appliance.

Referring to FIGS. 1 and 2, a pullout-drawer assembly 40 is slidably received within the compartment 28 through the opening 47. The assembly 40 includes a cradle 42 providing a support structure. For example, the cradle has a top member 44, a bottom member 46, a front member 48, and a back member 50. The top member 44 is joined between the front and back members 48, 50, and the bottom member 46 is joined between the front and back members 48, 50 to form a rectangular outer frame 52. This, of course, is just one example.

The cradle 42 may include a plurality of bins 54 or other storage for supporting food items. In the illustrated embodiment, three vertically arranged bins 54 are shown; however, more or fewer bins may be used in other embodiments. The bins 54 may be formed of plastic. One or more embodiments, the bins are formed of a clear plastic to aid visibility of the food items stored therein. The bins 54 may be supported on holders 55, which may be provided on the front member 48 and the back member 50. The holders 55 may be integrally formed or separate components attached to the cradle 42. The bins 54 may be removably supported by the holders 55. The pullout-drawer assembly 40 may be configurable by the user. For example, the user may choose between different sized bins, different bin locations (e.g., bin holders may be vertically adjustable or multiple holders provided), bin depths, etc.

The cradle 42 may be slidably connected to the pullout-drawer compartment 28 by guide members and/or sliders. For example, a lower slider 56 may be attached to the lower surface of the bottom member 46. The lower slider 56 may have a first rail 58 attached to the lower surface and a second rail 60 attached to a bottom surface of the compartment 28. The first and second rails 58, 60 are configured to slide relative to each other with reduced friction. Options for friction reducing components include bearings, rollers, low-friction coatings and materials, and the like.

An upper guide member 64 may be connected between a top surface of the top member 44 and a top surface of the pullout-for compartment 28. The upper guide member 64 may have a guide 66 fixed to the top member 44 and a track 68 fixed to the top of the compartment 28. Alternatively, the upper guide member 64 may be a slider having a first rail attached to the top surface of the member 44 and a second rail attached the top surface of the compartment 28. The first and second rails are configured to slide relative to each other with reduced friction as discussed above. The guide members and/or sliders may include a soft-close mechanism, a soft-open mechanism, or both. The top and bottom placement of the sliders is merely one example, and the sliders may be placed in any suitable location, such as on the sides of the cradle 42. Alternatively, the upper cradle 42 may have the sliders and the lower cradle may have the guide members.

The pullout-drawer assembly 40 is slidable, such as via the guide member and the slider, in a front-to-rear direction between an open position (shown in FIG. 1) in which the cradle 42 projects from the compartment 28 and a closed position in which the cradle 42 is fully received with the compartment 28. This arrangement provides two-sided access to the bins 54, which may easy access to the food items, as opposed to the traditional one-sided access of swinging door bins.

A door 70 is mounted on the front member 48 of the cradle 42. The door 70 is configured to engage a front frame of the cabinet 21 that surrounds the opening 47 when the assembly 40 is in the closed position. The door 70 may also seal with a flap 71 provided on the door 72 of the main compartment 26. A seal or gasket 75 may be provided on the door to limit the loss of cold air when the door is closed.

The refrigerator 20 may be cooled by refrigeration system (not shown), such as a vapor-compression refrigeration system. The refrigeration system may include at least a compressor, a condenser, an evaporator, and a thermal expansion device. These components are interconnected by refrigerant lines configured to convey refrigerant therebetween. During operation, the compressor compresses the refrigerant into a hot gas. This hot gas is routed to the condenser, which rejects heat from the refrigerant to the outside air causing the refrigerant to condense. The now liquid refrigerant passes through the expansion device and drops the temperature and pressure of the refrigerant. The refrigerant then passes through the evaporator where the refrigerant receives heat through the evaporator and boils. The refrigerant, now in a cool gaseous state, is routed compressor to begin the cycle again.

Figure 3:
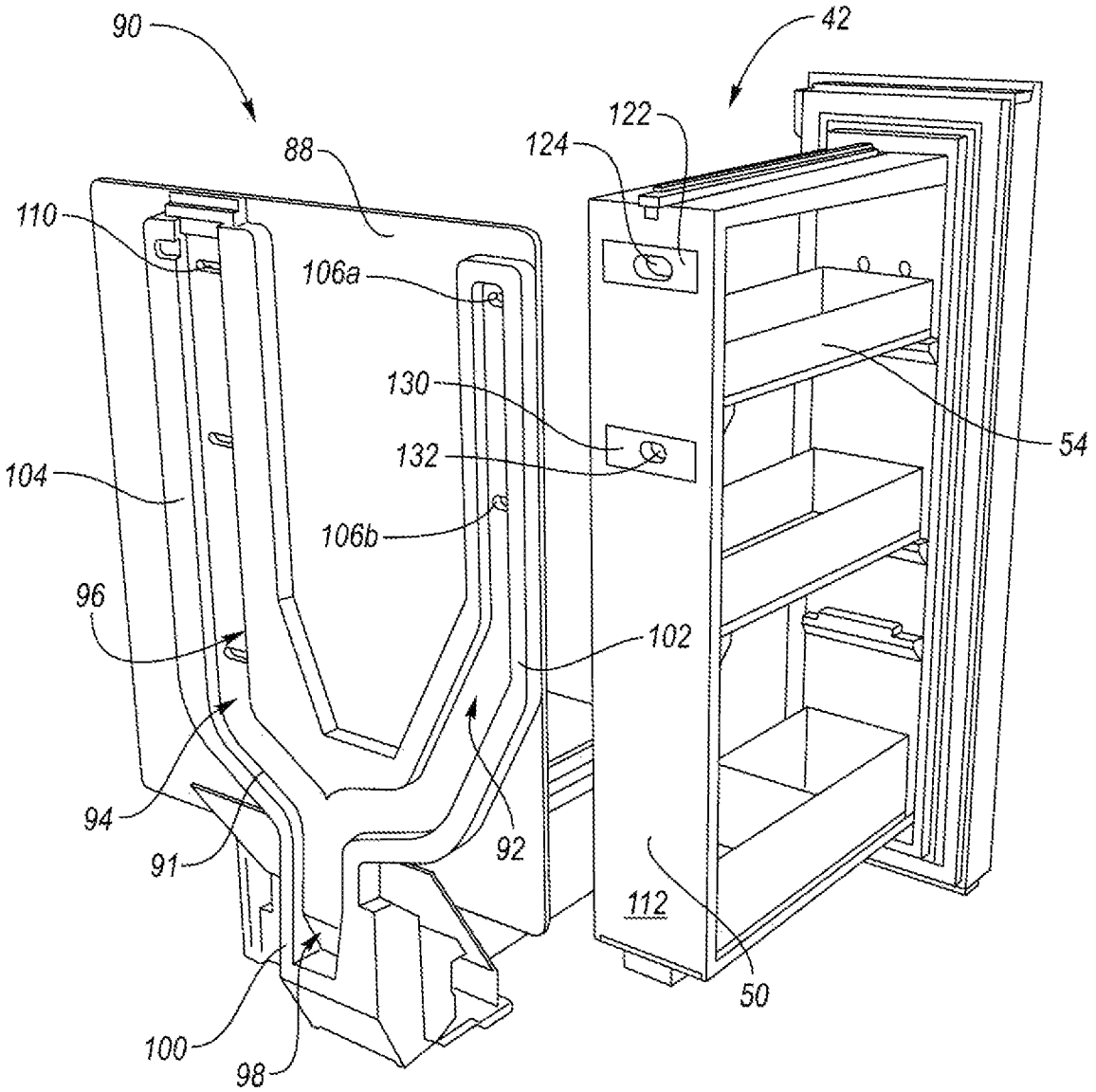
FIG. 3 is a partial rear perspective view of the refrigerator appliance.

Referring to FIGS. 2 and 3, the refrigerator 20 includes an air-circulation system 90 (also known as a cold-air system) that operates in conjunction with the refrigerant system to cool at least the compartments 26, 28. For example, the air-circulation system 90 is configured to convey air across the evaporator thus generating cold air for the food storage areas. The evaporator may include fins, coils, or other features to facilitate efficient heat transfer between the airstream and the refrigerant.

The air-circulation system 90 may include a cover 88 that defines air ducts 91. The cover 88 may be formed of plastic. The air ducts 91 define one or more air paths 96. The air path 96 may extend through the evaporator. The air path 96 may be generally Y-shaped having first and second branches 92 and 94 that extend from a common path 98. To provide this air path 96, the ducts 91 may include a main duct 100 that branches into a first duct 102 defining the first branch 92 and a second duct 104 defining the second branch 94. The first duct 102 defines openings or vents 106 for providing cold air to the pullout compartment 28 and the second duct defines openings or vents 110 for providing cold air to the main compartment 26. Having dedicated vents for each compartment 26, 28 ensures sufficient cooling for each compartment and facilitates a uniform temperature between the compartments. The cover may also define a cold air return (not shown) in one or both of the compartments 26, 28. In one example, the cold air return is located in a lower portion of the main compartment 26. The cover 88 may be disposed against the back wall of the liner 23 and cooperates with the liner 23 to define the air path 96.

Figure 4:
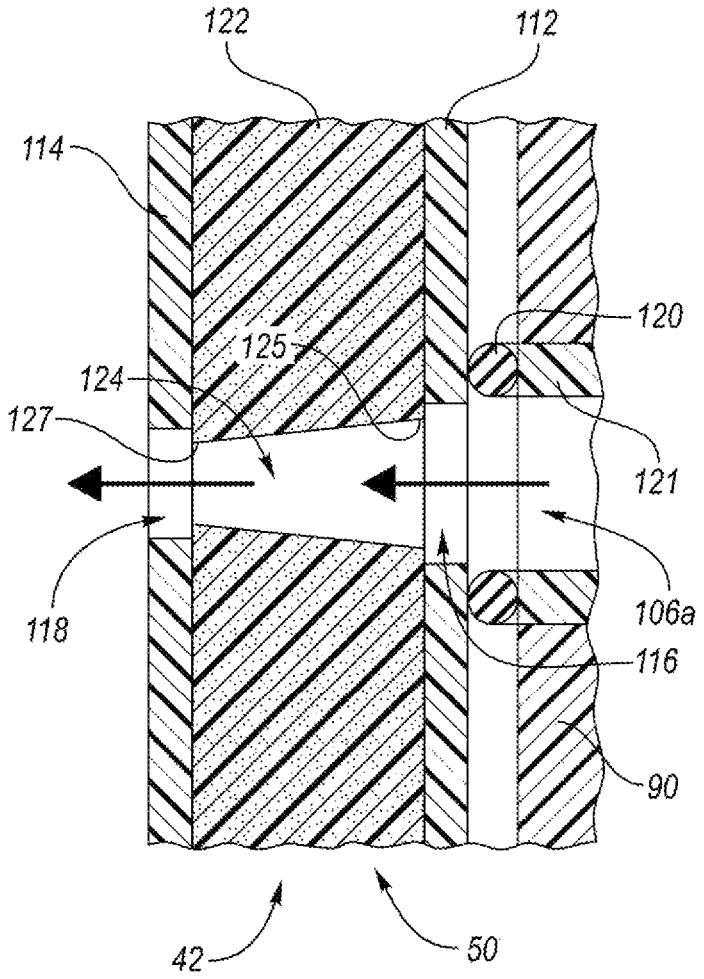
FIG. 4 is a side cross-sectional view of the cradle and air duct of the refrigerator appliance.

Referring to FIGS. 3 and 4, the cradle 42 may be formed of injection-molded plastic. For example, the cradle 42 may be formed as two half shells that are connected using fasteners, adhesive, or the like. This construction may result in the cradle having a hollow interior within each of the members, e.g., the top member 44, bottom member 46, front member 48, and back member 50 are each hollow. Other construction techniques may be employed that also result in a hollow cradle. The hollow back member 50 may include an outer panel 112 and an inner panel 114. The outer panel 112 defines a first opening 116 and the inner panel 114 defines a second opening 118, which may be centered on a common central axis. The openings 116, 118 allow air to flow from the air circulation system 90 to the bins 54. The openings 116, 118 provide a direct route from the vent(s) to the food located within the storage bins 54 and may more efficiently cool the food items rather than relying on airflow around the sides of the back member 50. The openings may not be required in all embodiments depending upon the size of the refrigerator, the clearance around the sides of the back member, and the airflow characteristics within the fresh-food area.

FIG. 4 illustrates the cradle 42 in the closed position which results in the back panel 112 seating on a gasket (or other type of seal) 120 of the vent 106*a* of the air duct 102. The vent 106*a* may include a vent plate 121 that supports the seal 120 and defines an opening. One or more fins for directing air may be supported within the opening of the vent 106*a*. The vent plate 121 may be configured to connect to the vent 106*a* defined by the cover member 88. For example, the vent plate 121 may include features for snap fitting to the cover member 88. Alternatively, the vent plate 121 may be attached to the cover member 88 by fasteners such as screws or rivets, or attached by adhesive, or the like. In one or more embodiment, the vent plate 121 may include an insertion portion that is received within the vent 106 and a flange portion that is received on the front surface of the cover 88. Alternatively, the vent plate 121 may be fully received within the vent 106*a*.

A flow guide 122 is disposed within the hollow back member 50. The flow guide 122 may be formed of foam or other material having low thermal conductivity to reduce or prevent condensation. In one or more embodiments, the foam is expanded polystyrene (EPS). The flow guide 122 may be formed separately from the cradle 42. Here, the flow guide 122 may be installed in one of the cradle halves prior to the halves being connected to each other. The hollow interior of the cradle 42 may include walls or other structure that defines a seat for the flow guide 122.

The flow guide 122 defines a channel 124 extending between the outer panel 112 and the inner panel 114, i.e., in the front-to-rear direction of the refrigerator appliance 20. The channel 124 may be generally centered within the openings 116 and 118 allowing air to pass through the back member 50. That is, the channel 124 cooperates with the openings 116, 118 define an airflow path through the back member 50 of the cradle 42.

The openings 116 and 118 may be larger than the channel 124 and may have a different shape. For example, the openings 116, 118 may be square, whereas the channel 124 is circular or ovular. The cross-sectional shape of the channel 124 is not limited to the illustrated embodiment and may have any suitable cross-sectional shape such as square, rectangular, triangular, octagonal, hexagon, etc.

The channel 124 may change in size along its length. For example, the channel 124 may have a variable diameter, a variable height, and/or a variable width depending upon the cross-sectional shape. The cross-sectional area of the channel 124 may be largest towards the outer panel 112 and the smallest towards the inner panel 114. That is, the channel 124 tapers along its length and gets progressively smaller in the direction of air flow, i.e., back to front. In the illustrated embodiment, the channel 124 has a continuous taper between the outer end 125 of the channel 124 and the inner end 127 of the channel 124. However, the channel 124 may have multiple sections of constant, different cross-sectional areas that are interconnected by tapering transition sections. Alternatively, the cross-sectional area of the channel 124 may be constant along its length.

As best shown in FIG. 3, the duct 102 may include multiple vents, e.g., 106*a* and 106*b*, that are the same or similar to each other. For example, a second vent 106*b* may be provided in the cover 88 and may be similar to the vent 106*a* described above. The cradle 42 may include multiple flow guides and openings (the same or similar to those described above) and matching in number to the vents 106. For example, the cradle 42 may include a second flow guide 130 that defines a second channel 132. The second flow guide 130 may engage with the vent 108 as described above.

The second flow guide 130 may be disposed below the upper flow guide 124. The upper and lower flow guides may be disposed above and below the upper storage bin 54 as shown in FIG. 3. This provides targeted airflow to the upper two storage bins 54. The lower storage bin may not include a dedicated airflow path and instead relies on sinking cold air provided by the flow guides 124/130. Alternatively, a third set of openings and flow guide may be provided for the lower storage bin if required for cooling.

The channeling 124 may be the same as the channeling 132 or they may be different in one or more respects, i.e., shape, size, or tapered or constant. For example, the channel 124 of the upper flow guide 122 may have a larger cross-sectional area than the channel 132 of the lower flow guide 122*b*. Additionally and/or alternatively, the cross-sectional shapes of the channels 124 and 132 may be the same or different.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A refrigerator appliance comprising:

a cabinet defining a refrigeration cavity having side-by-side first and second compartments;

one or more shelves disposed in the first compartment;

a pullout-drawer assembly associated with the second compartment, the assembly including a cradle slidably connected to the second compartment such that the cradle is horizontally slidable in a front-to-rear direction between an open position in which the cradle projects from the second compartment and a closed position in which the cradle is fully received with the second compartment, wherein the cradle defines at least two bins configured to store a food item; and a cold-air system including a first duct having a first vent opening into the first compartment, and a second duct having a second vent opening into the second compartment to provide cool air to each of the at least one bin, a flow guide arranged on the cradle at each of two of the at least two bins to interface with the second duct and defining a channel open to the second duct to receive air from the cold-air system and provide air to the at least two of the at least two bins, the channel having a cross-sectional diameter that decreases as it extends from the second duct to each of the at least one bin.

2. The refrigerator appliance of claim 1, wherein the pullout-drawer assembly further includes a door that seats against the cabinet when the cradle is in the closed position.

3. The refrigerator appliance of claim 1, wherein the at least one bin is a plurality of vertically arranged bins.

4. The refrigerator appliance of claim 1, further comprising a gasket circumscribing the second vent, wherein, when the cradle is in the closed position, the gasket engages with channel of the flow guide.

5. The refrigerator appliance of claim 1, wherein the flow guide is formed of a different material than the cradle.

6. The refrigerator appliance of claim 5, wherein the flow guide is formed of foam.

7. The refrigerator appliance of claim 1 further comprising a divider separating the first and second compartments.

8. The refrigerator appliance of claim 1, wherein the pullout-drawer assembly further includes a slider having a first rail fixed to the second compartment and a second rail fixed to the cradle, wherein the first and second rails are configured to slide relative to each other to move the cradle between the open and closed positions.

9. The refrigerator appliance of claim 1, wherein the cradle is rectangular having a back member, a front member, a top member, and a bottom member.

10. The refrigerator appliance of claim 9, wherein the back member is hollow and has opposing first and second panels defining first and second openings, respectively, that are aligned with each other, the cradle further having a flow guide disposed in the back member and defining a channel that extends from the first opening to the second opening.

11. The refrigerator appliance of claim 9, wherein the front member defines a first holder and the back member defines a second holder, wherein the bin is supported on the first and second holders.

12. A refrigerator appliance comprising:

refrigeration cavity;

a divider received in the cavity to form first and second compartments;

a pullout-drawer assembly associated with the second compartment, the assembly including a cradle that is slidable into and out of the second compartment;

at least two food-storage bins supported on the cradle; and a cold-air system including a first duct having a first vent opening into the first compartment, and a second duct having a second vent opening into the second compartment, a flow guide arranged on the cradle at each of two of the at least two bins to interface with the second duct and defining a channel open to the second duct to receive air from the cold-air system and provide air to the at least two of the at least two bins, the channel having cross-sectional diameter that decreases as it extends from the second duct to each of the at least one bin.

13. The refrigerator appliance of claim 12, wherein the divider defines an opening so that the first and second compartment are in fluid communication.

14. The refrigerator appliance of claim 12, wherein the cradle has a hollow backwall having opposing first and second panels, that are aligned with each other, the flow guide disposed in the backwall.

15. A refrigerator appliance comprising:

a fresh-food compartment; and a pullout-drawer assembly slidable received within the compartment, the assembly including:

a cradle having a front member, a back member, a top member, and a bottom member, wherein the back member is hollow, a plurality of stacked bins vertically arranged within the cradle;

a flow guide disposed in the back member and defining an air channel at each of two of the bins, the air channel having a cross-sectional diameter that decreases as it extends from the back duct and opens to at least one of the bins, and an air vent arranged to engage with the flow guide of the cradle to supply an air stream to the air channel when the pullout-drawer assembly is closed.

* * * * *